US005399250A

United States Patent [19]

Moon et al.

[11] Patent Number: 5,399,250

[45] Date of Patent: Mar. 21, 1995

[54] BIPOLAR ELECTROLYZER

[75] Inventors: Sang Bong Moon; Ju Hwan Jo, both of Daejeon; Jun Seon Choi, Seoul; Ho Cheol Shin; Jung Hee Han, both of Daejeon, all of Rep. of Korea

[73] Assignee: Han Yang Chemical Corp., Seoul, Rep. of Korea

[21] Appl. No.: 121,914

[22] Filed: Sep. 17, 1993

[30] Foreign Application Priority Data

Mar. 5, 1992 [KR] Rep. of Korea ..... 92-36667

[51] Int. Cl.[6] ..... C25B 9/00; C25B 15/08

[52] U.S. Cl. ..... 204/255; 204/256

[58] Field of Search ..... 204/254–256, 204/257–258

[56] References Cited

U.S. PATENT DOCUMENTS

| | | | |
|---|---|---|---|
| 3,785,951 | 1/1974 | Fleck | 204/268 |
| 4,108,752 | 8/1978 | Pohto et al. | 204/268 X |
| 4,425,216 | 1/1984 | Neymeyer | 204/270 |
| 5,066,378 | 11/1991 | Meneghini | 204/258 X |

*Primary Examiner*—Donald R. Valentine

*Attorney, Agent, or Firm*—Birch, Stewart, Kolasch & Birch

[57] ABSTRACT

The present invention relates to an ion exchange membrane type electrolyzer producing chlorine and metal alkali hydroxide. The features include the unit electrolyzer comprises an anode partition wall made of titanium; a cathode partition wall made of nickel; an electrical conduction plate of appropriate dimension for electrical connection; and a current distribution frame. The electrical connection between each unit electrolyzer is provided by spring type metal plates explosively welded.

14 Claims, 4 Drawing Sheets

BIPOLAR ELECTROLYZER

BACKGROUND OF THE INVENTION

1. Field of the Invention

The present invention relates to a bipolar electrolyzer comprising a plurality of unit electrolyzers. More particularly, the present invention relates to a bipolar electrolzyer suitable for producing chloride and alkali hydroxide by electrolyzing an aqueous solution of an alkali metal chloride, which comprises a plurality of unit electrolyzer connected with each other by an explosion-welded spring-type metal plate coupled by explosion-welding and multi-layered electric conduction plates maintaining the current density and the concentration of the electrolyte uniformly, current distribution frame protecting the cation exchange membrane and maintaining the current uniformly, and a slanted frame wall disposed within each unit electrolyzer.

2. Description of Prior Art

There have been many prior art patents related to the bipolar electrolyzer to produce chlorine and alkali metal such as caustic potash comprising an anode compartment, a cathode compartment and cation exchange membrane disposed therebetween, low-current high-voltage electric power being supplied to anode of one end unit electrolyzer and cathode of the other end unit electrolyzer and the cation exchange membrane being used as the separation membrane.

Particularly, as the prior patents regarding electrical connection between the unit electrolyzers, U.S. Pat. No. 4,111,779 discloses an electrolyzer in which the material of the partition wall of one side unit electrolyzer is titanium and the material of the partition wall of the opposite side unit electrolyzer is iron and the whole partition walls are joined together by explosion-welding.

Also, European Pat. No. 0172495 discloses a electrolyzer in which electrical connection is provided by inserting a noded plate between partition plate.

Moreover, German Pat. No. 2551234 discloses an electrolyzer in which the unit electrolyzers of plastic material are electrically connected by securing means such as bolts and nuts. Finally, Japanese Laid-Open Patent 54-90079 discloses an electrolyzer having the connecting parts made of ultrasonic welding or titanium-copper-stainless steel.

On the other hand, as prior patent regarding the inside of electrolyzer, particularly, the structure of electrical conductor is located between the electrode and electrolyte partition wall, European pat. No. 220,659 discloses an electrolyzer having the electrical conductor of a single plate in which a plurality of openings are formed. U.S. Pat. No. 4,389,289 discloses an electrolyzer having the electrical conductor of a single plate in which cavities are formed at both sides. Also, U.S. Pat. No. 4,417,960 discloses an electrolyzer having the frame type electrical conductor.

Further, as the prior patent regarding the shape of bipolar walls for a bipolar electrolyzer, an electrolyzer whose bipolar walls are manufactured by explosion-welding and the anode compartment and the cathode compartment can not be isolated is known (S. Ogawa, Chem. Age, India, 31 1980 441:K, MOTANY. ibid 31, 1980,457).

U.S. Pat. No. 4,568,434 discloses an electrolyzer of which bipolar walls are manufactured by explosion-welding and the anode compartment and the cathode compartment can be isolated. An electrolyzer whose bipolar walls are not joined by explosion-welding and the anode compartment and the cathode compartment can be isolated is also known (Journal of Electrochemistry 12, 1982,631).

Moreover, U.S. Pat. No. 4,105,515 discloses an electrolyzer which can reduce the voltage of the electrolzyer by reducing the bubble size of chlorine gas by operating the inner pressure of the electrolyzer higher than the atmosphere pressure.

An electrolyzer must have high performance, convenience in operation and the manufacturing or maintenance cost should be low. However, most of the above mentioned patents do not satisfy these above requirements. High performance electrolyzer having the partition wall of explosion-welding has the problem of high manufacturing cost due to much time and manpower of explosion-welding. An electrolyzer having the partition wall without explosion-welding has the advantage of low manufacturing and maintenance cost, but has the problem of low performance.

In case of manufacturing unit electrolyzers with plastic material, because the partition walls of the electrolyzer should be made thick considering its mechanical strength, it is impossible to manufacture a thin and small electrolyzer. Therefore, this type of electrolyzer is restricted to only a big electrolyzer. Furthermore, during the operation of an electrolyzer comprising a plurality of unit electrolyzer connected in series, if one unit electrolyzer causes any problem, the trouble shooting must be proceeded after stopping all the unit electrolyzers connected directly to it. Therefore, it causes the problem of bad working conditions.

In the conventional electrolyzer, the electrodes (1 mm thickness) and electrical conduction plates (2 mm thickness) are welded directly. However, it is very difficult to weld them together and the welded state is very poor. Further, this method not only lowers the performance of the electrolyzer, but also deteriorates the stability of whole electrolyzer system. If the inner pressure of electrolyzer is at the level of 0.5 $kg/m^2$, the electrodes and electrical conduction plate are separated and causes the problem of local heating. Consequently, the heat damages the membrane significantly which results in stability problems for the whole electrolyzer system.

SUMMARY OF THE INVENTION

It is an object of the present invention to provide a new and improved bipolar electrolyzer which can be manufactured at any size or shape according to the working condition due to sufficient mechanical strength is provided by the nickel cathode compartment and titanium anode compartment of each unit electrolyzer.

It is another object of the present invention to provide a bipolar electrolyzer which is improved in that only a unit electrolyzer having problems can be replaced even during the operation of the electrolyzer by forming the non-explosion-welding partition wall and employing the bolt and nut for the connecting means and a plurality of spring type metal plates for the current conduction means. Therefore, the time required to assemble and disassemble the electrolyzer can be reduced and the performance can be improved.

It is further object of this invention to provide a bipolar electrolyzer having multi-layered electrical conduction plates for maintaining the current density and electrolyte concentration within electrolyte of each unit electrolyzer uniformly, and a slanted frame wall for protecting cation exchange membrane caused by the accumulation of chlorine gas.

The characteristic features to accomplish the above purposes are as follows:

To electrically connect the cathode compartment partition wall and cathode; anode compartment partition wall and anode, and to maintain the current density and electrolyte concentration within the electrolyte of each unit electrolyzer uniformly, the electrical conduction plate of predetermined size is multi-layered. To maintain the current density between the conduction plate and electrodes more uniformly, a current distribution frame is provided.

Said cathode compartment partition wall and anode compartment partition wall are electrically connected by a plurality of spring-type explosion-welded metal plates.

To permit inflow and outflow through connection means within each unit electrolyzer, an electrolyte inlet and a product outlet are provided at lower and upper portion of each unit electrolyzer respectively, a slanted surface is provided to prevent the accumulation of gas at the inner corner of each unit electrolyzer.

BRIEF DESCRIPTION OF THE DRAWINGS

The present invention will now be described in more detail with reference to the accompanying drawings, wherein.

DETAILED DESCRIPTION OF THE INVENTION

Figure 1:
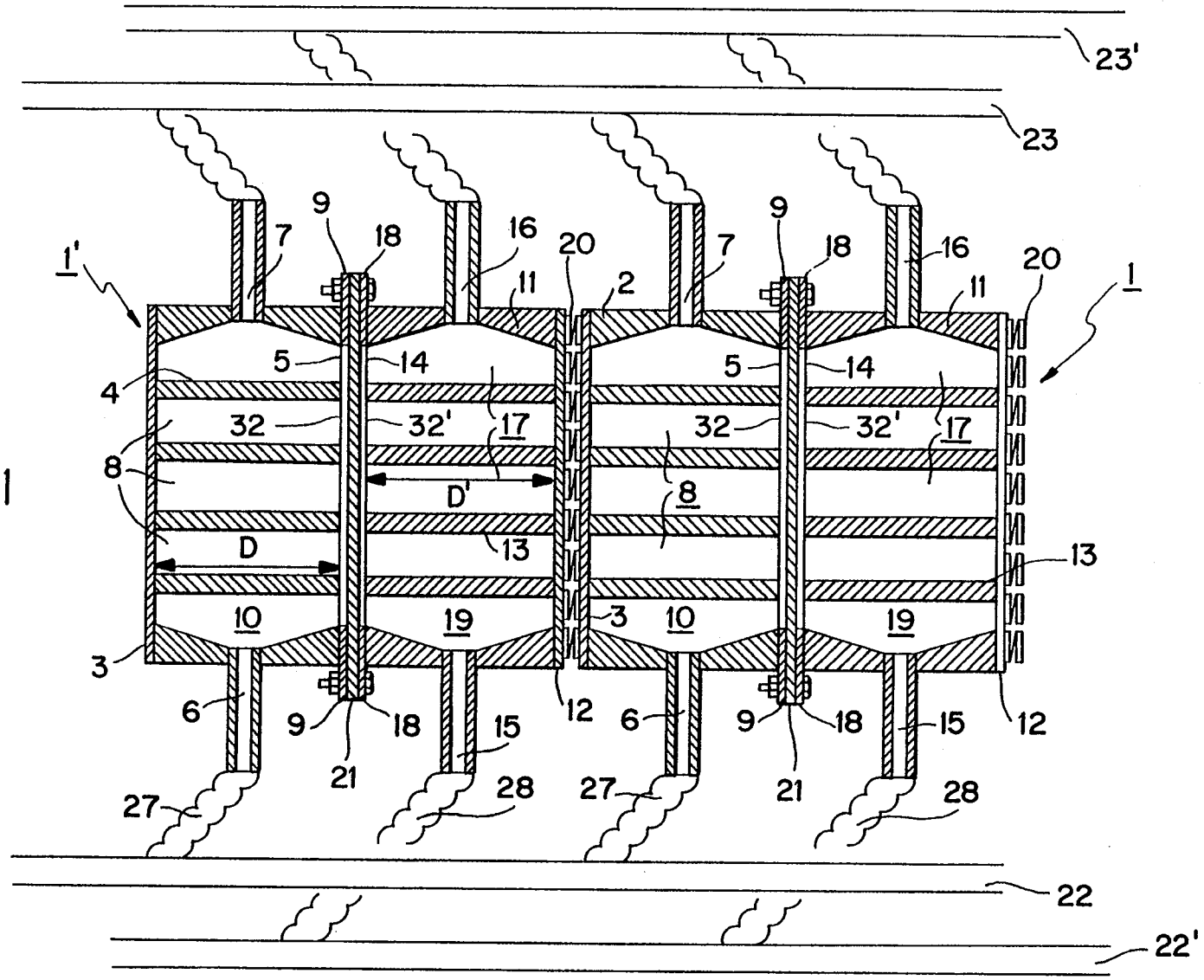
FIG. 1 is a cross-sectional view showing the serial arrangement of unit electrolyzer constituting the bipolar electrolyzer according to the present invention.

FIG. 1 is a cross-sectional view showing the serial arrangement of unit electrolyzers comprising an anode compartment (10), a cathode compartment (19) and the cation exchange membrane (21) inserted therebetween. A multi-layered electrical conduction plate (4) which will be described below is provided to the anode compartment (10) in order to electrically connect the anode compartment frame wall (2) and anode compartment partition wall (3) attached to one side of the anode compartment frame wall (2) and the anode (5) welded to the electrical conduction plate Similarly, a multi-layered electrical conduction plate (13) which will be described below is provided to the cathode compartment (19) in order to electrically connect the cathode compartment frame wall (11) and the cathode compartment partition wall (12) attached to one side of the cathode compartment frame wall (11) and the cathode (14) welded to the electrical conduction plate (13). Electrolyte and products are passed through the passages (8, 17) of said multi-layered electrical conduction plates (4,13).

The anode compartment frame wall (2) and the cathode compartment frame wall (11) are symmetrically disposed with respect to said cation exchange membrane (21). Electrolyte inlets (6, 15) are connected to one side of lower part of each unit electrolyzer (1) and the product outlets (7, 16) are connected to the opposite side upper part thereof.

The electrolyte inlets (6, 15) are connected to the supply head (22, 22') disposed below each unit electrolyzer (1) through flexible hose (27, 28) connected therebetween. Similarly, the product outlets (7, 16) are connected to the outlet head (23,23') disposed above each unit electrolyzer (1) through the flexible hose (27, 28).

During the electrolysis of brine using the conventional bipolar electrolyzer without slanted surface at the inner corner of anode frame wall (2) and cathode frame wall (11), because the hydroxyl ion moving from cathode compartment (19) to anode compartment (10) and the chlorine accumulated in the anode compartment (10) are diffused to cation exchange membrane (21), the performance of cation exchange membrane (21) is deteriorated to the crystal forming within the membrane (21) by the reaction below:

$$2NaOH + Cl_2 \rightarrow NaCl + NaOCl + H_2O$$

According to the present invention, the slanted surfaces are provided to the inner corners of anode frame wall (2) and cathode frame wall (11). The slant angle is larger than five degrees. Therefore, the cation exchange membrane (21) is protected from gas produced from the electrolysis product such as chlorine gas accumulated at inner corner of electrolyzer during electrolysis of brine.

If the installation of the electrolyte inlets (6, 15) and product outlets (7, 16) are allowed, the thickness of said anode compartment frame wall (2) and the cathode compartment wall (3) is not specifically restricted.

However, the thickness is usually 10 mm–50 mm, and 40 mm is preferable from the standpoint of the economy. As the material of anode compartment frame wall (2) and cathode compartment frame wall (11), the chemical resistant metal such as iron, nickel and titanium or plastics such as polyethylene, polypropylene, PVC resin and fluorine resin. It is preferable, however, to use metal considering the cost, the leak of electrolyte and mechanical strength. For example, in case of electrolysis of brine, it is most preferable that the anode compartment frame wall (2) is made of titanium and cathode compartment frame wall (11) is made of nickel.

On the other hand, since the electrical conduction plates (4, 13) are welded to the partition walls (3, 12), active anode (5) and active cathode (14), current is supplied from anode compartment partition wall (3) to the active anode (5).

The electrical conduction plates (4, 13), which have the trend of mutual trade-off, affect the distribution of the current density and electrolyte concentration.

According to the present invention, the passages (8, 17) and electrical conduction plates (4, 13) of optimum size are disposed at the optimum position to maintain the current density at the active electrode surfaces uniformly by permitting the wide contact between partition wall and electrodes and maintain the concentration of the electrolyte uniformly within the electrolyzer. As to the material used for the said electrical conduction plate (4, 13), it should have the resistance to the chemicals and the high electrical conductivity. In case of the electrolysis of brine, the conductivity is improved by using the titanium for the conduction plate (4) of the anode compartment and the nickel for the conduction plate (13) of the cathode compartment and it is further improved by coating the conduction plates (4, 13) with the platinum group oxide. The current distributing frame (32), which makes the current density uniformly on the part of the electrode, is installed between the conduction plates (4, 13) and the electrodes (5, 14) so as to let the current coming through the conduction plate distribute uniformly onto the whole parts of the electrodes.

Furthermore, in order to reduce the electrical contact resistance between the anode partition wall (3) and the cathode partition wall (12), the material such as the copper, the nickel, titanium or alloy thereof is used as the conduction medium (20). Especially, in case of the electrolysis of brine, the copper-nickel alloy is preferably used for inducing current properly since the anode compartment wall (3) and the cathode compartment wall (12) consist of different metals. The said conduction medium (20) has the spring type support structure. Therefore, when the unit electrolyzers are assembled by using the connecting rod, each unit can be closed to the adjacent electrolyzer to let the current flow quite well.

It is required that the anode partition wall (3) and the cathode partition wall (12) has enough thickness to bear the inner pressure of the electrolyzer and let them weld onto the conduction plate (4, 13). From the standpoint of the mechanical strength and economy, the thickness of 1 to 3 mm is reasonable. As to the material for the partition wall, it is advantageous to use the same one as that of the frame wall (2, 11) and they are connected to each other by bolting and welding.

The anode is made of material comprising the titanium and the coated platinum metallic oxide, wherein the platinum oxide includes the iridium oxide, the ruthenium oxide, the titanium oxide, the zirconium oxide, etc. To improve the performance, the mixture of the platinum group compound can also be used.

Since the chlorine gas or oxygen gas rising from the anode (5) exist between the anode (5) and the cation exchange membrane (21) and blocks the current flow, the electrolysis voltage would be risen. In order to avoid the above-mentioned effect, the electrode in the shape of the porous plate having the porosity of 40% is used to exhaust the gas from the back side of the anode (5). By using this, blocking of the current could be prevented and the voltage lowered.

The flat metal plate with punctures or the expanded metal electrode is used as the said porous plate. In the electrolysis of brine, the expanded metal electrode is preferable and its shape is determined from the standpoint of the cost and the consumption of material. If possible, it is required that the distance between the anode (5) and the anode compartment partition wall (3) (as shown by D in FIG. 1) should be extended so as to urge the gas rising from the anode (5) to exhaust from the back side of the anode (5) and prevent the accumulation of the gas between the electrodes (5, 14) and the cation exchange membrane (21) to be lower voltage.

The cathode is made of materials comprising iron, nickel or alloy thereof and it is coated with the cathode activating agent such as raney nickel, and nickel oxide.

The structure of the cathode (14) is preferably the same as that of the anode (5) and the distance (as shown by D' in FIG. 1), if possible, is required to be extended by the same reason as in the said anode (5). However, in the cathode compartment (19), the minimum distance of 20 mm is required. If not, in other words, the distance is shorter than 20 mm, the gas rising from the cathode (14) is mixed and forms the gas filled space larger than 20 mm, so that it blocks the electrolysis current instantly and the electrolysis voltage rises.

Since the gaskets (9, 18) are located at both ends of the cation exchange membrane (21) so as to prevent the leakage of electrolyte from the unit electrolyzer, if possible, the gasket having the flat surface would be far more efficient. The gasket should have the resistance to the chemical reaction in connection with electrolyte and product thereof. In the electrolysis of brine, it is preferable to use ethylene-propylene rubber, chloroprene rubber, butyl rubber or fluorine rubber. From the standpoint of cost and performance, fluorine rubber would be preferable for the gasket (9) and ethylene-propylene rubber for the gasket (18). The configuration and size of the gasket is determined under the same condition as the frame wall of the electrolyzer compartment.

The cation exchange membrane (21) is made from fluorine resin having the cation exchange axis and located between the anode (5) of the anode compartment (10) and the cathode (14) of the cathode compartment (19). The said exchange axis of the cation exchange membrane (21) is sulfonic acid form, carboxyl acid form or the composite forms thereof. When the composite form is used, the sulfonic acid form is located at one side of the membrane facing the anode (5) and the carboxyl acid form is located at the other side of the membrane facing the cathode (14).

In operation of the electrolyzer, the inner pressure of unit electrolyzer (1) is maintained above the atmospheric pressure (0.2–2 kg/cm$^2$) and controlled by the control valve (not shown in figures) located at the outlet head (23, 23').

Figure 2A:
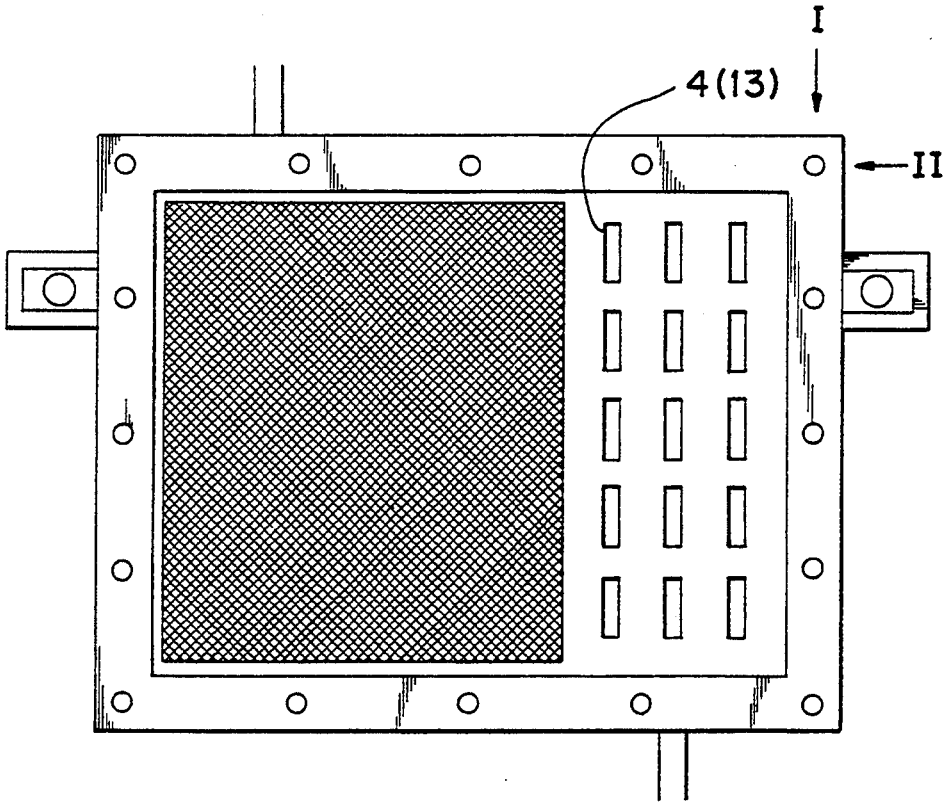
FIG. 2A and 2B are top plan views of electrolysis compartment of a unit electrolyzer.
Figure 2B:
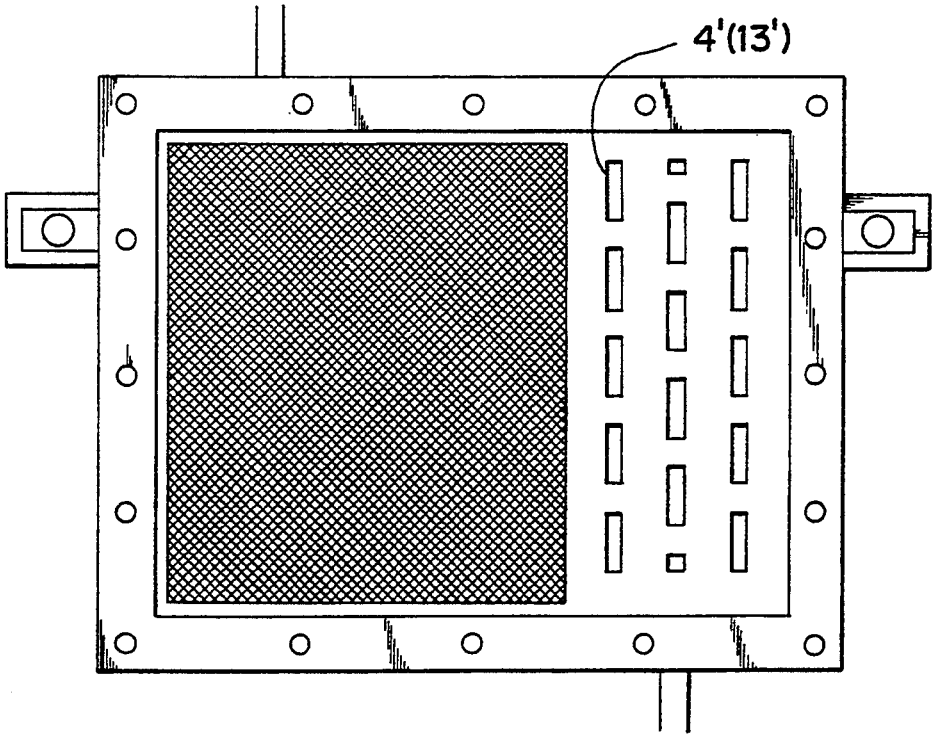

FIG. 2A and 2B illustrate the plan view of the electrolyzer compartment composing the unit electrolyzer wherein the electrical conduction plates (4, 13) of the anode compartment (10) and the cathode compartment (19) should be at the same position.

As viewing in the direction of arrow (I) described in FIG. 2A, the location of the conduction plates (4) have so much influence on the concentration distribution of current density that they should be arranged as narrowly as possible. From the standpoint of the distribution of the electrolyte density, the intervals of 200 to 500 mm are preferred and the 300 mm is further preferred.

FIG. 2B illustrates another embodiment of the bipolar electrolyzer in accordance with the present invention. In FIG. 2B, the adjacent conduction plates (4', 13') are crossed over each other, so that the electrolyte density can be distributed further uniformly.

Figure 3:
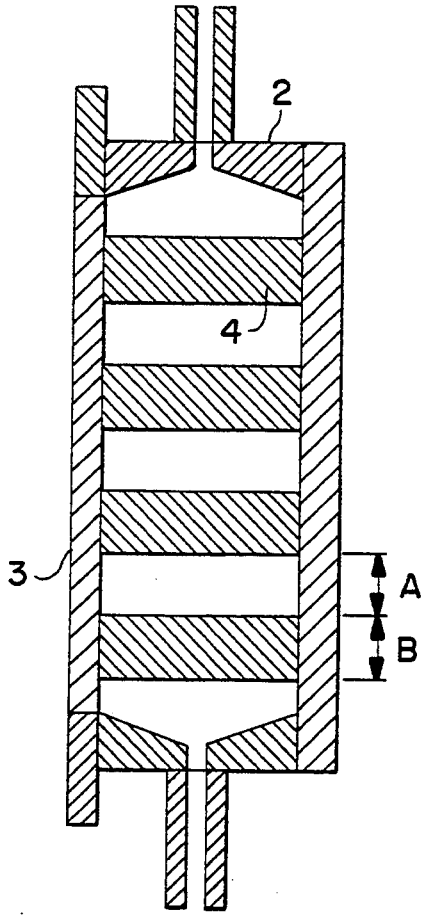
FIG. 3 is a side view of anode compartments and cathode compartments.

FIG. 3 illustrates the side view of the anode compartment and the cathode compartment composing the unit electrolyzer. As viewing in the direction of the arrow (II) in FIG. 2A, the thickness (B) of the conduction plate (4) is 100 mm to 500 mm and the thickness of 200 mm to 400 mm is preferred.

As defined by the equation (A/(A+B)*100) in which A is the interval of the conduction place and B is the unit length of conduction plate, 60 to 80% is preferred and 70% is further preferred. When it is lower than 60%, the current density would become ununiform. When it is higher than 80%, the electrolyte density would become ununiform.

FIG. 4A, 4B, 4C and 4D show the structure of metal plates formed by explosion-welding which electrically connect the unit electrolyzer of the present invention. Each metal plate (20) includes the nickel plate (30) and copper plate (31). As can be seen from the Figures, at the center of the copper plate (31) or at the both or one end of the copper plate (31), the nickel plate (30) is connected to the copper plate (31) having the predetermined size and configuration. When engaging the unit electrolyzer to one another electrically, the metal plate (20) is located at the partition wall of the adjacent unit electrolyzer (1'). The nickel plate (30) is welded to the partition wall (12) of the cathode compartment of the unit electrolyzer (1'). Thereafter, by pressing the unit electrolyzer (1) against the other unit electrolyzer (1') with the predetermined force, the copper plate (31') of the unit electrolyzer (1) is located closely and electrically connected to the other copper plate (31') which has been welded to the nickel plate (30) of the unit electrolyzer (1') by the explosion-welding.

Figure 4A:
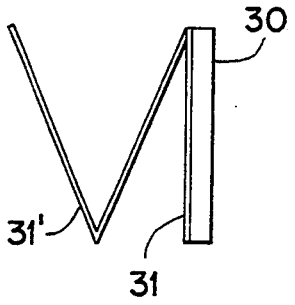
FIG. 4A, 4B, 4C and 4D show examples of the structures of metal plates connected by explosion-welding for electrically connecting unit electrolyzer according to the present invention.
Figure 4B:
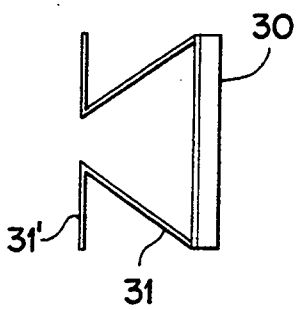
Figure 4C:
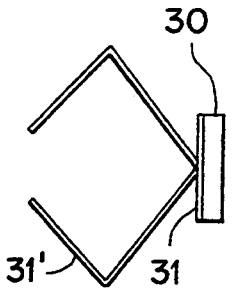
Figure 4D:
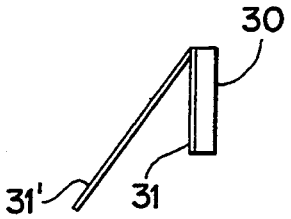

As can be seen from FIG. 4A, the metal plate (20) is made of the copper plate (31) and the nickel plate (30) welded to each other by the explosion-welding, wherein the copper plate (31) has the width of 100 mm, the length of 28.5 mm and thickness of 1 mm and the nickel plate (30) has the width of 100 mm, the length of 28.5 mm and the thickness of 2 mm. The copper plate (31') has the width of 100 mm, the length of 280 mm and the thickness of 1 mm. At one end of the copper plate (31), the copper plate (31') is welded by 1 mm with "V" shape which is formed by folding the center of the copper plate (31'). In FIG. 4B, the copper plate (31') is welded to the copper plate (30) at both ends thereof and then it is folded at the predetermined location. In FIG. 4C, the copper plate (31') in the shape of lozenge are welded to the center of the copper plate (31). In FIG. 4D, the flat copper plate (31') is welded to the copper plate (31) at the end thereof.

Figure 5:
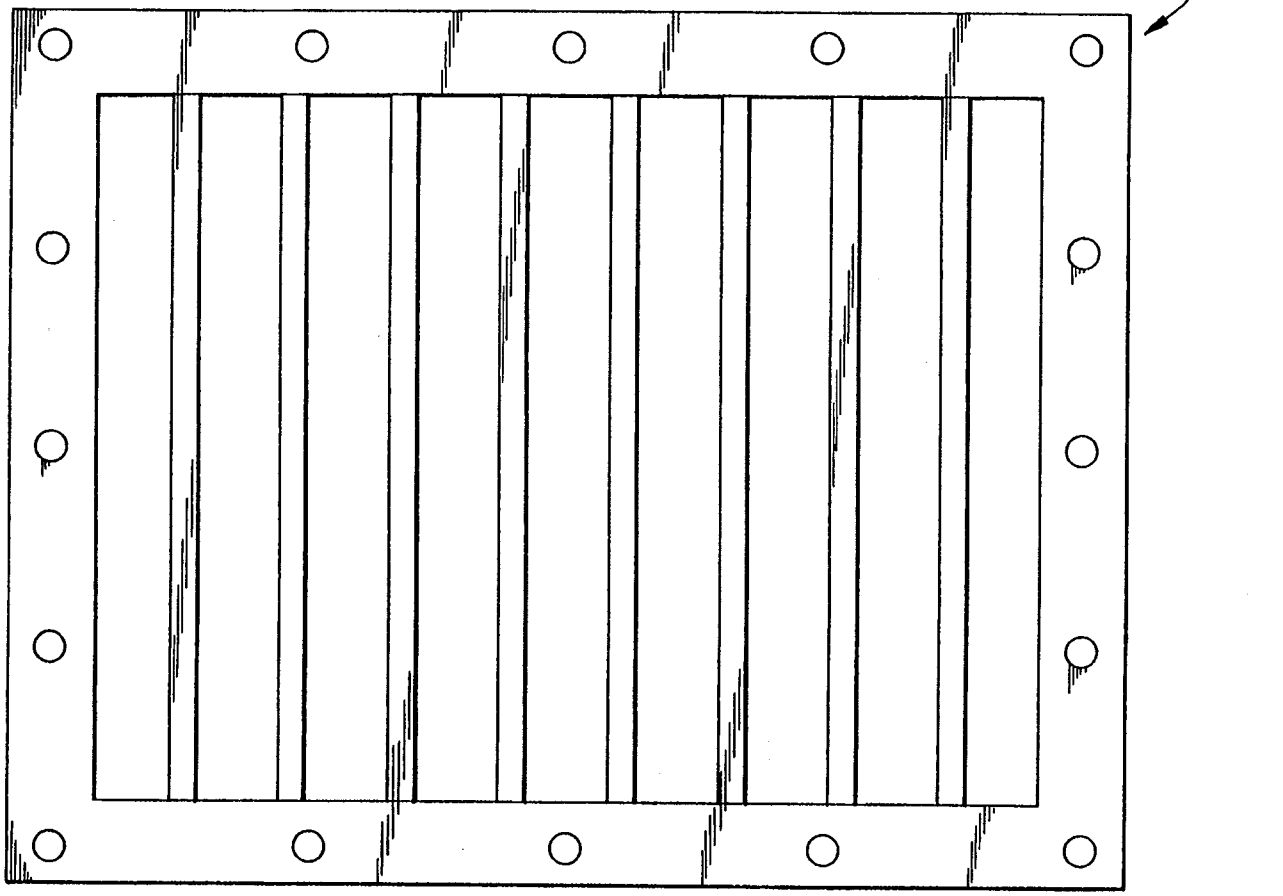
FIG. 5 shows the structure of current distribution frame provided between electrodes and electrical conduction plate for maintaining the current density uniformly.

FIG. 5 shows the frame providing the uniform current density between the electrical conduction plate and the electrode. While the current flowing into the cathode partition wall (11) is being provided through the conduction plate (13), the current distribution frame (32) alleviates the current distribution in advance, so that it prevents the current from distributing locally on the membrane. Furthermore, by covering an inner portion of the electrolyzer, the gas stagnation area, in which gas rising from the electrolyzer is mixed and stagnated, can be isolated from the membrane. Therefore, the membrane can be protected from the influence by the blistering.

As described more specifically below, the current distribution frame (32) of the thickness of 4–5 mm makes the welding operation more convenient and let the current flowing from the conduction plate distribute onto the surface of the electrode. The length of the conduction plate (a) is such that it does not prevent the gas rising from the electrode. The length of 1–10 mm is preferable and the length of 4 mm is further preferable. The intervals (b) are made to coincide with the intervals of the conduction plate.

Also, in the conventional electrolyzer, in order to protect the membrane, the slant frames are provided at every corner to prevent the stagnation of the chlorine gas within the electrolyzer. The chlorine gas diffuses to the membrane and reacts with the sodium hydroxide to form the crystal which is detrimental to the performance of the electrolyzer. This method is rather expensive. According to the present invention, the corners within which the gas is stagnated is replaced with the conduction frame, so that the shape of routing becomes unnecessary.

EXAMPLE 1

The bipolar electrolyzer of the present invention shown in FIG. 1 has the following conditions:

The width of the anode compartment (D): 50 mm
The width of the cathode compartment (D'): 35 mm
The length of the electrolyzer: 1000 mm
The width of the electrolyzer: 2000 mm
The intervals of the conduction plate in the electrolyzer: 300 mm
The unit length of the conduction plate (B)(FIG. 3) is 200 mm.
The intervals of the conduction plate (A)(FIG. 3) is 50 mm.
The form of the adjacent conduction plate follows FIG. 2A The anode is a dimensionally stabilized electrode (titanium coated with ruthenium-titanium oxide).

The cathode has active electrode (steel coated with raney-nickel).

The current distribution frame of the FIG. 5 exists between the conduction plate and electrode.

The cation exchange membrane of Nafion 90209 made by Dupont of U.S.A. is positioned between the unit electrolyzers. Fluorine-polymer Teflon having the thickness of 1 mm is used as the gasket material for the anode and the ethylene-propylene rubber of 2 mm is used for the cathode.

The brine with the concentration of 300 gpl is acidified by the hydrochloric acid to the pH 4 and provided into the anode. The water is provided into the lower part of the cathode. The operational condition is as follows:

Temperature: 90° C.
Current density: 3.0 ka/m$^2$
Outlet concentration of the anode compartment: 200 gpl
Concentration of sodium hydroxide: 30%
Anode compartment pressure: 1.5 Kg/cm$^2$
Cathode compartment pressure: 1.6 kg/cm$^2$ In the above described condition, the voltage of the electrolyzer is 3.32 volt and the current efficiency is 97%.

EXAMPLE 2

The structure and the operational condition is the same as Example 1. However, it has the conduction plates crossed over as shown in FIG. 2B. The voltage of the electrolyzer is 3.2 volt and the current efficiency is 97.5%.

As described herein above, the bipolar electrolyzer of the present invention includes the cathode compartment, the cation exchange membrane and the anode compartment which are arranged continuously by the connecting means, such as connecting rod other than explosion-welding. Therefore, it can be easy to assemble and disassemble the electrolyzer and the labor cost can be reduced considerably. Furthermore, inside of the electrolyzer, a plurality of the conduction plates are formed and the slant surfaces are also formed at the corner, so that the performance of the electrolyzer is improved.

On the other hand, the bipolar electrolyzer of the present invention is able to be used not only for the alkaline metal chloride, but also for the other electrolysis such as the electrolysis of the water.

What is claimed is:

1. In a bipolar electrolyzer comprising a plurality of unit electrolyzers each having an anode compartment, cation exchange membrane and a cathode compartment, wherein:

said cathode compartment and said anode compartment comprising partition walls (3,12) and frame walls (2,11), wherein said partition walls (3,12) are attached to one side of said respective frame walls (2,11);

electrolyte inlets (6,15) and product outlets (7,16) for inflow of electrolyte and outflow of product to and from each unit electrolyzer (1) through connecting means being provided at one side of lower and upper part of each unit electrolyzer (1);

slant surfaces being formed at inner corners of each unit electrolyzer for preventing the accumulation of gas;

multi-layered electrical conduction plates (4,13) of predetermined size being provided for electrically connecting said partition walls (3,12), said frame walls (2,11), and said anode (5) and cathode (14) and for maintaining the current density and the concentration of the electrolyte uniformly;

each unit electrolyzer (1) being electrically connected by a plurality of conduction mediums (20) being disposed between said partition walls (3,12);

local high current density of electrodes (5,14) being reduced by a current distribution frame (32) disposed between the conduction medium (20) and electrodes (5,14);

each unit electrolyzer (1) being serially arranged by connecting rods.

2. The bipolar electrolyzer of claim 1, wherein said electrical conduction plates (4, 13) are crossed over with adjacent conduction plates (4', 13').

3. The bipolar electrolyzer of claim 1, wherein the unit length of said electrical conduction plates (4, 13) is 200 mm.

4. The bipolar electrolyzer of claim 1, wherein slant surfaces of five degrees are formed at inner corner of said frame walls (2, 11).

5. The bipolar electrolyzer of claim 1, wherein each of said electrolyzers (1) is capable of withstanding inner pressures between 0. kg/cm$^2$ and 2.0 kg/cm$^2$.

6. The bipolar electrolyzer of claim 1, wherein the minimum distance (D') between the said frame wall (11) and said cathode (14) is longer than 20 mm.

7. The bipolar electrolyzer of claim 1, wherein said conduction medium comprises a two layer plate having a copper plate (31) as a top layer and a nickel plate (30) as a bottom layer, said nickel plate (30) being joined to the cathode partition wall (12) and a V-shaped copper plate (31') being welded to one end of the copper plate (31).

8. The bipolar electrolyzer of claim 1, wherein said conduction medium comprises a two layer plate having a copper plate (31) as a top layer and a nickel plate (30) as a bottom layer, said nickel plate (30) being joined to the cathode partition wall (12) and a plurality of V-shaped copper plates (31') being welded to both ends of the copper plate (31).

9. The bipolar electrolyzer of claim 1, wherein said conduction medium comprises a two layer plate having a copper plate (31) as a top layer and a nickel plate (30) as a bottom layer, said nickel plate (30) being joined to the cathode partition wall (12) and a flat copper plate (31') being welded to one end of the copper plate (31).

10. The bipolar electrolyzer of claim 1, wherein said conduction medium comprises a two layer plate having a copper plate (31) as a top layer and a nickel plate (30) as a bottom layer, said nickel plate (30) being joined to the cathode partition wall (12) and a lozenge shaped copper plate (31') being welded to the center of the copper plate (31).

11. A bipolar electrolyzer comprising an anode compartment, a cathode compartment, and a cation exchange membrane (21) therebetween;

said anode compartment comprising an anode frame wall (2), an anode partition wall (3) which is attached to one side of said anode frame wall (2), and an anode (5) which is attached to the other side of said anode frame wall (2);

said cathode compartment comprising a cathode frame wall (11), a cathode partition wall (12) which is attached to one side of said cathode frame wall (11), and a cathode (14) which is attached to the other side of said cathode frame wall (11);

an anode multi-layered conduction plate (4) being provided in said anode compartment which electrically connects said anode frame wall (2) and anode partition wall (3) to said anode (5);

a cathode multi-layered conduction plate (13) being provided in said cathode compartment which electrically connects said cathode frame wall (11) and cathode partition wall (12) to said cathode (14);

a plurality of conduction mediums (20) being provided on an exterior surface of the anode partition wall (3) or the cathode partition wall (12) or both;

wherein slant surfaces are provided on the anode frame wall (2) and the cathode frame wall (11) at the interior corners of said respective compartments.

12. The bipolar electrolyzer of claim 11, wherein said anode multi-layered conduction plate (4) is disposed such that the value of $(A/(A+B)\times 100)$ is in the range of 60 to 80%, wherein A is the interval between the conduction plates and B is the unit length of the conduction plate.

13. The bipolar electrolyzer of claim 11, wherein said cathode multi-layered conduction plate (13) is disposed such that the value of $(A/(A+B)\times 100)$ is in the range of 60 to 80%, wherein A is the interval between the conduction plates and B is the unit length of the conduction plate.

14. A bipolar electrolyzer, comprising at least two bipolar electrolyzers according to claim 11 arranged in series and being in electrical contact with each other by means of said conduction mediums (20).

* * * * *